United States Patent [19]

Bean, Jr.

[11] 4,085,938

[45] Apr. 25, 1978

[54] ELECTION GAME APPARATUS AND METHOD OF PLAYING SAME

[76] Inventor: James H. Bean, Jr., 336 Jerris St., SE., Salem, Oreg. 97302

[21] Appl. No.: 778,075

[22] Filed: Mar. 16, 1977

[51] Int. Cl.[2] ..... A63F 3/04

[52] U.S. Cl. ..... 273/279

[58] Field of Search ..... 273/134 C, 134 D, 135 R, 273/135 AB, 135 AC, 135 AA, 152.6

[56] References Cited

U.S. PATENT DOCUMENTS

| | | | |
|---|---|---|---|
| 1,481,713 | 1/1924 | Hulsmann | 273/135 AB |
| 1,907,255 | 5/1933 | Ferrari, Jr. | 273/135 AB |
| 2,209,117 | 7/1940 | Garrett | 273/134 C |
| 3,318,601 | 5/1967 | MacLeod | 273/134 AC |
| 3,368,816 | 2/1968 | Milazzo et al. | 273/134 AC |

OTHER PUBLICATIONS

"Dice Baseball Fever", Newsweek, Aug. 23, 1976, p. 60.

*Primary Examiner*—Anton O. Oechsle
*Attorney, Agent, or Firm*—Chernoff & Vilhauer

[57] ABSTRACT

A game apparatus for two players comprises a board having located thereon a map of the United States divided into the 50 respective states, and a deck of 50 playing cards, each being identified with one of the states. Indicated on each of the cards are three win alternatives, two lose alternatives, and one draw alternative which are listed randomly along with respective associated identifying numerals ranging from one to six, for determining the outcome of the play of that card upon the rolling of a die. Two sets of markers, each set having a contrasting color and each having 50 individual markers shaped to fit over respective ones of the states outlined on the board, are used to indicate the winner of each state played. In play, the deck of cards is stacked in random order and the players alternately roll the die in turn to determine which numerical alternative on the topmost card will be followed on each turn. Rolling a win alternative results in a win for the person rolling the die, and rolling a lose alternative results in a win for the other player, with the winner of each state receiving the electoral votes associated with that state. When a draw alternative is indicated, no one wins the state at that time and the card is returned to the bottom of the deck to be replayed at a later time.

9 Claims, 12 Drawing Figures

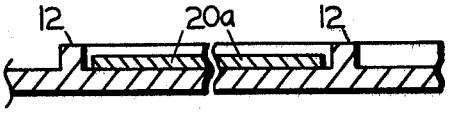
FIG. 2
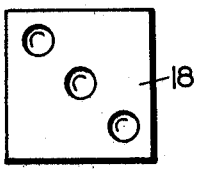
FIG. 3
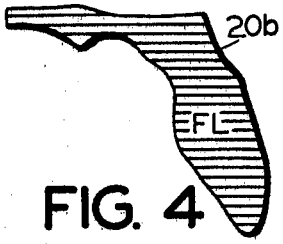
FIG. 4
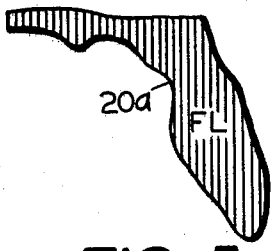
FIG. 5
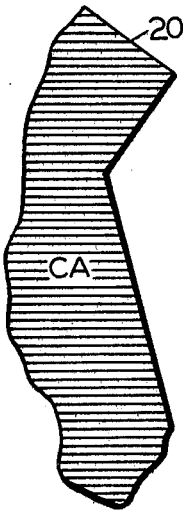
FIG. 6
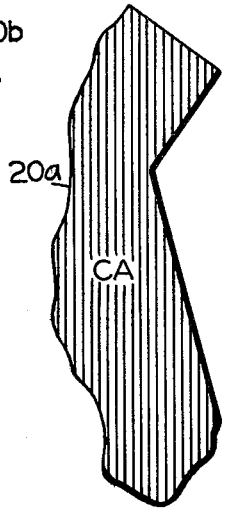
FIG. 7
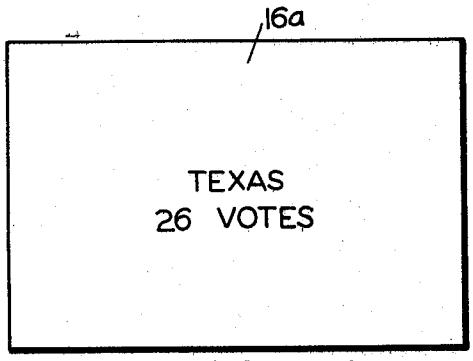
FIG. 8A
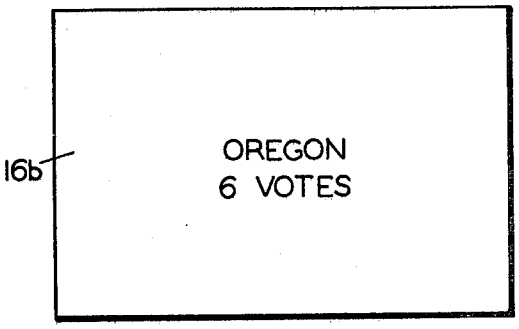
FIG. 9A
1 WIN ALTERNATIVE
2 LOSE ALTERNATIVE
3 DRAW ALTERNATIVE
4 LOSE ALTERNATIVE
5 WIN ALTERNATIVE
6 WIN ALTERNATIVE
16a
FIG. 8B
1 DRAW ALTERNATIVE
2 WIN ALTERNATIVE
3 WIN ALTERNATIVE
4 LOSE ALTERNATIVE
5 WIN ALTERNATIVE
6 LOSE ALTERNATIVE
16b
FIG. 9B
SCORE SHEET
| | STATE | CANDIDATE A | TOTAL | CANDIDATE B | TOTAL |
|---|---|---|---|---|---|
| 1 | | | | | |
| 2 | | | | | |
| 3 | | | | | |
| 4 | | | | | |
| 5 | | | | | |
| 6 | | | | | |
22
FIG. 10

ELECTION GAME APPARATUS AND METHOD OF PLAYING SAME

BACKGROUND OF THE INVENTION

This invention relates to game apparatus and the method of its play. In particular it relates to such a game utilizing a board and a deck of playing cards for closely simulating the affect of the United States electoral college method of presidential election.

Games relating to the interplay of the electoral college in the outcome of the United States elections are well known in the prior art. However, the prior art games of this class do not accurately portray the electoral college process, and particularly do not show the suspense aspect of this system which arises on election night. For example, none of the prior art games have provisions for depicting the situation which arises when a state is "too close to call" even when a large percentage of its popular vote is in.

Typical of the prior art games of this class are games wherein cards are distributed to the players in some manner and then during each play the players try and obtain cards of other players by superior strength. Accordingly, which player wins the electoral vote of each state is not determined independently for each state by a system of chance but is determined competitively dependent upon the votes of other states, which bears no similarity to the actual election process.

SUMMARY OF THE INVENTION

In its basic concept the game of the present invention comprises a deck of cards, one representing each of the states, having indicated thereon a predetermined number of win, lose and draw alternatives each randomly associated with one of a set of identifying indicia, and means by which one of a pair of players may randomly generate one of the identifying indicia on each play to determine which of the alternatives is followed on that play, thereby awarding the number of electoral votes associated with that state to one of the two players.

It is a further object of the present invention to provide such a game which accurately portrays the working of the electoral college in determining the outcome of a United States presidential election.

It is a further object of the present invention to provide such a game having markers for displaying on a board all of the states each player has won.

It is a still further object of the present invention to provide such a game where the winning of certain states which come into play is delayed until a later point in the game.

The foregoing and other objects, features, and advantages of the principal invention will be more readily understood upon consideration of the following detailed description taken in conjunction with the accompanying drawings.

BRIEF DESCRIPTION OF THE DRAWINGS

FIG. 2 is a sectional view taken on the line 2—2 of FIG. 1.

FIG. 3 is a plan view of a die used in the game.

FIGS. 4–7 are plan views of markers used in the game.

FIGS. 8A and 9A are top views of cards used in the game.

FIGS. 8B and 9B are bottom views of the cards shown in FIGS. 8A and 8B respectively.

FIG. 10 is a partial plan view of a score sheet used in the game.

Detailed Description of a Preferred Embodiment

Figure 1:
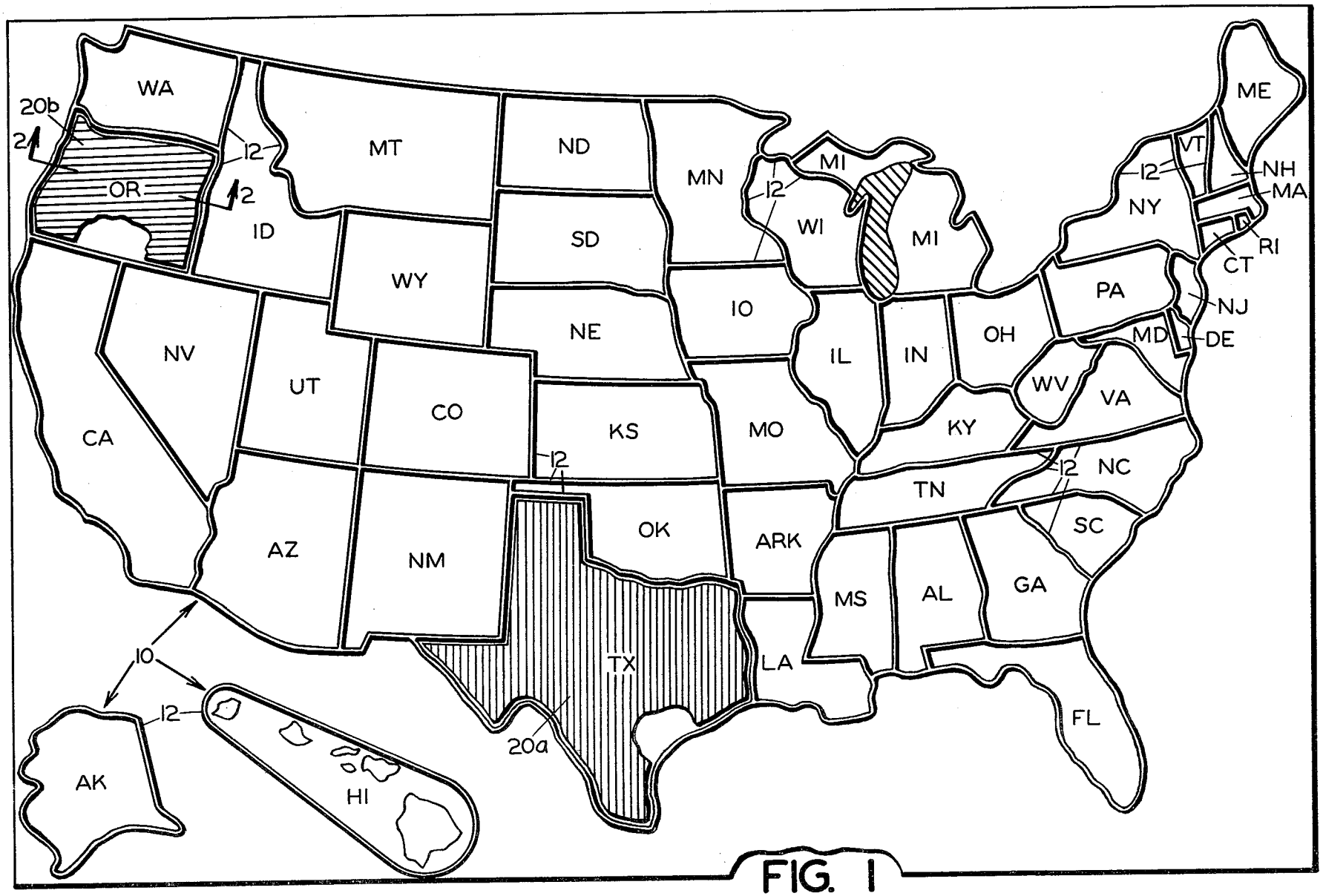
FIG. 1 is a plan view of the board upon which the game of the present invention is played.

Referring to FIG. 1 of the drawings, the game of the present invention is played on a game board 10 which generally displays a map of the United States. The map is divided into the 50 individual states with each state being bordered by a raised separation strip 12 to form an individual cavity. If desired, the map can be further illustrated to show additional features, such as key cities or rivers, and the number of electoral votes accorded each state can be indicated on the board within the boundaries of the respective states.

A deck of 50 playing cards 16, examples of which are shown in FIGS. 8A, 8B, 9A and 9B, provides the instructions for playing the game. There is one card for each state on the board and each card has indicated on a first side the name of one state and the number of electoral votes accorded to that state. In the embodiment illustrated there is no card for the district of Columbia and its electoral votes are included with those of the State of Maryland.

On the reverse side of each card a predetermined number of play alternatives are listed, showing win alternatives, lose alternatives and draw alternatives. While the total number of play alternatives, and the number of these alternatives appropriated for each category, can be varied to alter the odds of the game, in the present embodiment there are three win alternatives, two lose alternatives and one draw alternative, thus giving a particular player a 50% chance of winning and a 33% chance of losing a particular state. The alternatives are preceeded by respective consecutive numerals ranging from one to six, and the sequence in which the alternatives are listed relative to these numerals randomly varies from card to card. Thus, for example on card **16*a* in FIG. 8B, win alternatives follow numerals 1, 5 and 6, lose alternatives follow numerals 2 and 4 and the draw alternative follows numeral 3; while on a second card 16*b* in FIG. 9B, win alternatives follow numerals 2, 3 and 5 lose alternatives follow numerals 4 and 6, and the draw alternative follow numeral 1**.

The particular alternative on each card which is followed on the play of that card may be determined by a standard die 18, FIG. 3, having indicated on its respective faces arrays of dots ranging from one to six. Thus each face of the die numerically represents one of the alternative numerals on the cards. Alternately, a spin wheel or other means can be used for randomly generating the identifying indicia which are associated with each of the play alternatives.

Two sets of markers **20*a* and 20*b*** in contrasting colors are provided for placement on the game board to represent which player wins each of the states. Each set contains one marker for each state shaped to coincide with the outline of its associated state on the board, thereby allowing it to be inserted into the respective cavity. The abreviated name of the appropriate state is inscribed on the face of each of the markers for identifying them.

The number of electoral votes each player accumulates during the course of playing the game is indicated on a score sheet 22 having columns headed respectively by the titles: State; Candidate A; Total; Candidate B; and Total. The score sheet also is divided into 50 consecutively numbered rows for listing of the states as they are played.

The game is played by two persons, one who represents candidate A, and one who represents candidate B. Each is given one of the respective sets of markers 20*a* or 20*b* for placement on the states that he wins during play. The first player takes the topmost card 16 from the deck, which previously has been shuffled, and rolls die 18 to determine which of the play options on the card to follow. Accordingly, he will either win or lose the electoral votes of that particular state, or it will be a draw. If a win alternative is indicated, the player who threw the die wins that state and places the appropriate marker 20*a* from his set over that state on game board 10. If a lose alternative is indicated, there is an upset and the other player wins that particular state and places the appropriate marker 20*b* from his set over that state on the game board. If a draw is indicated, the state is considered "to close to call" at that time and the card for that state is returned to the bottom of the deck for later replay. The above procedure then is repeated alternately by each player until all of the cards have been played.

As a winner is determined for each card, the name of its state is entered in the state column on the score sheet 22, the number of electoral votes associated with that state is indicated under the winning candidate, and the cumulative total number of electoral votes won by that candidate is entered in the appropriate Total column. As soon as one candidate has won 270 or more electoral votes he becomes the winner.

It will be noted that each person will be favored in 25 of the states because 50% of the play options on each card are win alternatives and each player plays one half of the cards. Accordingly, the person rolling the die on each play has a 50% chance of winning that state whereas his opponent has a 33% chance to win it.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A game apparatus comprising:

(a) a board displaying a map of the United States showing each state thereof;

(b) a deck of playing cards equal in number to the number of states shown on the board, each card having indicated thereon one of the states represented on the board, there being one card for each state shown on the board;

(c) each card having indicated thereon an equal number of play alternatives including a predetermined number of win alternatives and a predetermined number of lose alternatives, and having indicated thereon a set of different identifying indicia, a respective one of said indentifying indicia being randomly associated with each of the play alternatives; and (d) means for randomly generating one of the set of identifying indicia.

2. The game apparatus of claim 1 wherein the play alternatives indicated on each card further include at least one draw alternative.

3. The game apparatus of claim 2 wherein the cards each contain six play alternatives and the means for randomly generating the identifying indicia comprises a die.

4. The game apparatus of claim 3 wherein the cards each contain three win alternatives, two lose alternatives and one draw alternative.

5. The game apparatus of claim 1 including at least two sets of markers, each of the markers of each set being associated with a respective one of the states represented on the board, and each set of markers being of a different color.

6. The game apparatus of claim 5 wherein each marker is shaped similarly to its associated state.

7. The game apparatus of claim 1 including a score sheet having columns headed by indicia indicating which state is played, which player won the state, the number of electoral votes associated with that state, and the cumulative total of electoral votes won by each player.

8. The method of playing a game for two players of the type having a board displaying a map of the United States showing each of the states thereof and a deck of playing cards equal in number to the number of states shown by the board, each playing card representing a respective state and each playing card indicating a predetermined number of win alternatives, a predetermined number of lose alternatives and at least one draw alternative, each alternative being identified by a particular one of a set of different identifying indicia on each card, said identifying indicia also being shown on a die, the method comprising:

(a) placing the cards in a randomly mixed stack;

(b) throwing the die alternately by each player in turn;

(c) following the alternative on the topmost card of the stack corresponding to the identifying indicia indicated by the die after each throw;

(d) awarding the number of electoral votes accorded the state represented on the topmost card to the player throwing the die if a win alternative is indicated by the die and topmost card, and awarding said number of votes to the other player if a loss alternative is indicated by the die and topmost card;

(e) removing the topmost card from the game if a win alternative or lose alternative is indicated by the die and topmost card; and (f) placing the topmost card on the bottom of the stack if a draw alternative is indicated by the die and topmost card.

9. The method of claim 8 including the step of placing a descriptive marker on the board over each state concurrently with the card corresponding to that state being removed from the game, said marker indicating which player won said state.

* * * * *